US005119769A

United States Patent [19]

Davis et al.

[11] Patent Number: 5,119,769

[45] Date of Patent: Jun. 9, 1992

[54] VERTICAL THREE CYLINDER TWO CYCLE ENGINE WITH SINGLE CARBURETOR

[75] Inventors: Eric A. Davis; Richard A. Davis, both of Mequon, Wis.

[73] Assignee: Brunswick Corporation, Skokie, Ill.

[21] Appl. No.: 707,706

[22] Filed: May 30, 1991

[51] Int. Cl.[5] ..... F02M 35/10

[52] U.S. Cl. ..... 123/52 M; 123/73 A; 123/73 C

[58] Field of Search ..... 123/52 M, 52 MC, 65 R, 123/73 A, 73 B, 73 C

[56] References Cited

U.S. PATENT DOCUMENTS

| | | | |
|---|---|---|---|
| 1,818,283 | 8/1931 | Spencer | 123/65 R |
| 2,773,489 | 12/1956 | Estes | 123/73 A |
| 3,060,914 | 10/1962 | Morand | 123/65 R |
| 3,592,173 | 7/1971 | Frehe | 123/73 A |
| 3,859,967 | 1/1975 | Turner et al. | 123/73 A |
| 4,181,101 | 1/1980 | Yamamoto | 123/73 A |
| 4,227,492 | 10/1980 | Haase | 123/52 M |
| 4,345,551 | 8/1982 | Bloemers | 123/52 M |
| 4,711,201 | 12/1987 | Ooyama et al. | 123/73 A |
| 4,777,913 | 10/1988 | Staerzl et al. | 123/73 A |
| 4,905,638 | 3/1990 | Curtis et al. | 123/73 A |

*Primary Examiner*—David A. Okonsky

*Attorney, Agent, or Firm*—Andrus, Sceales, Starke & Sawall

[57] ABSTRACT

In a two cycle internal combustion engine (80) comprising three cylinders (22, 24, 26) vertically in-line, a single intake manifold (82) services all three of the cylinders, and a single fuel delivery device (84), such as a carburetor, on the manifold delivers fuel to each of the cylinders. Location and orientation of the three reed block openings (90, 92, 94) relative to each other and relative to the throttle bore (128) provide desired fuel distribution. Manifold structure, including internal dams (142, 146) and a deflector plate (138), prevents an overly rich fuel mixture in the lower cylinder (26) at idle, and prevents an overly rich fuel mixture in the upper cylinder (22) at running speeds above idle.

28 Claims, 5 Drawing Sheets

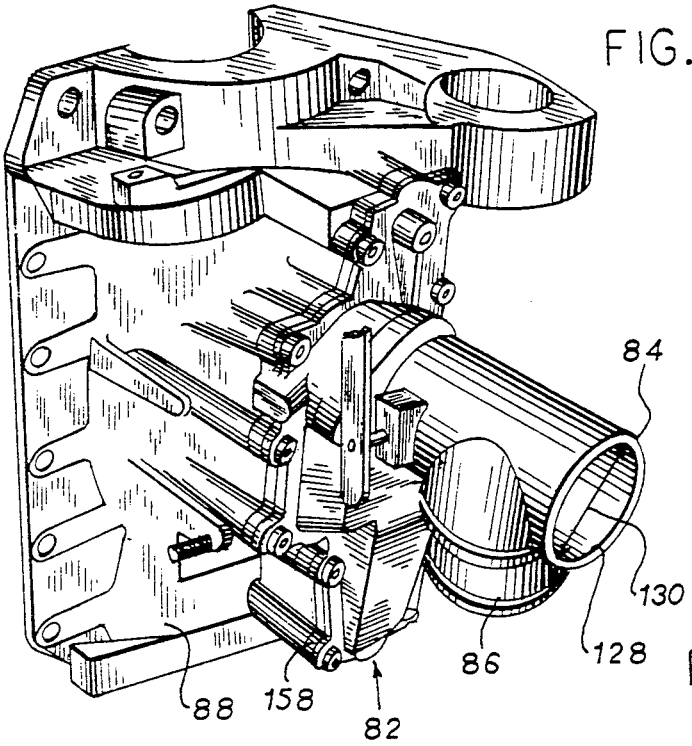
FIG. 5
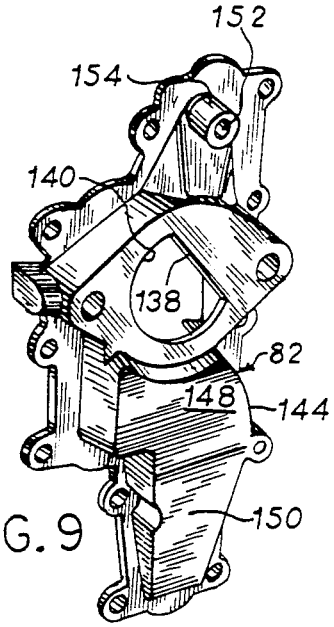
FIG. 9
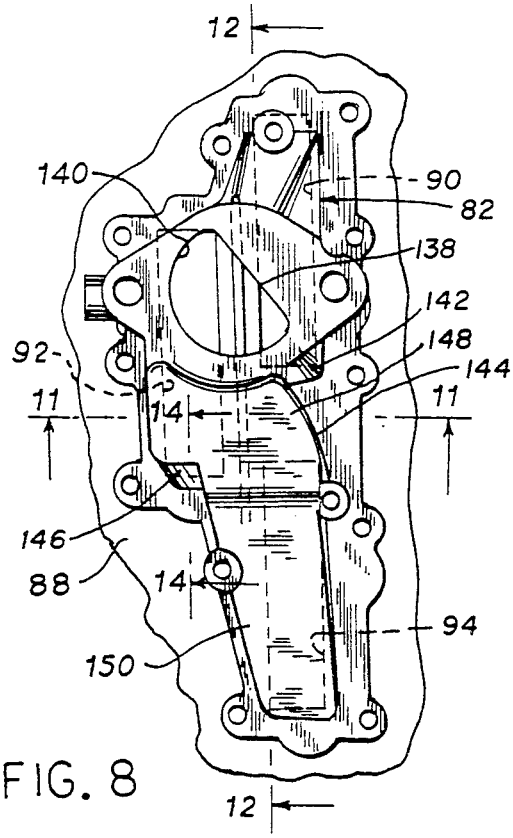
FIG. 8
FIG. 10
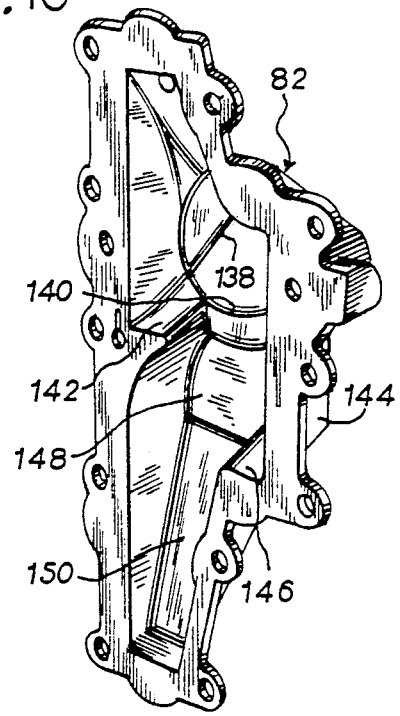

FIG. 15
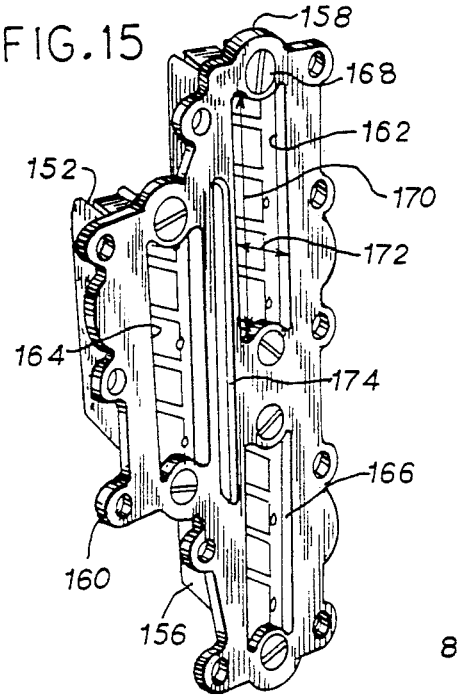
FIG. 6
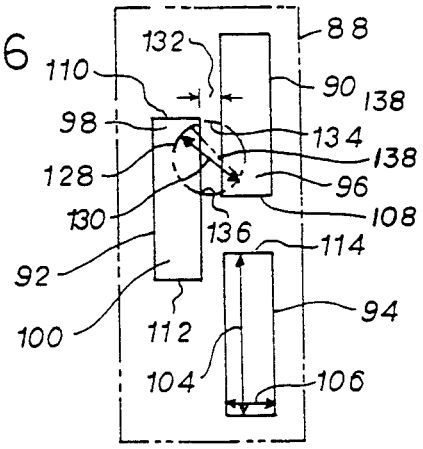
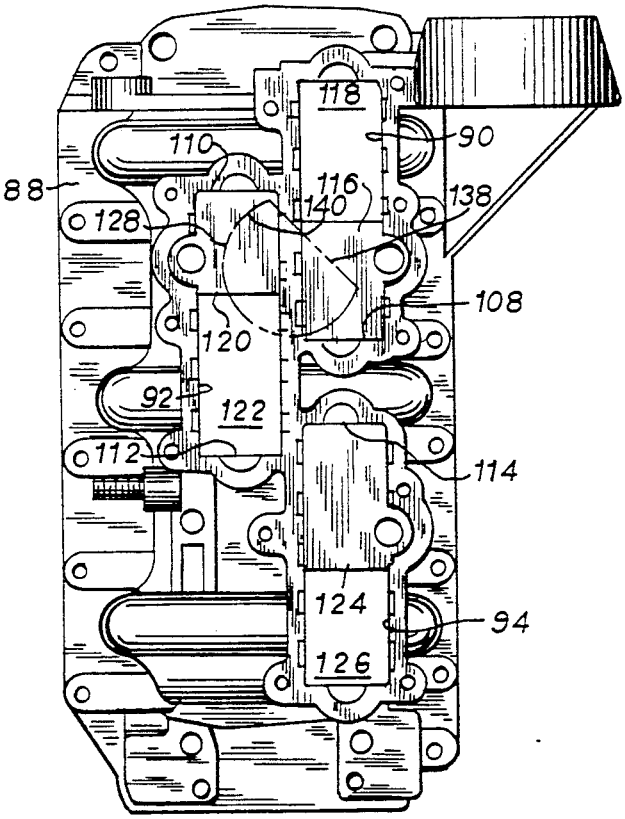
FIG. 7
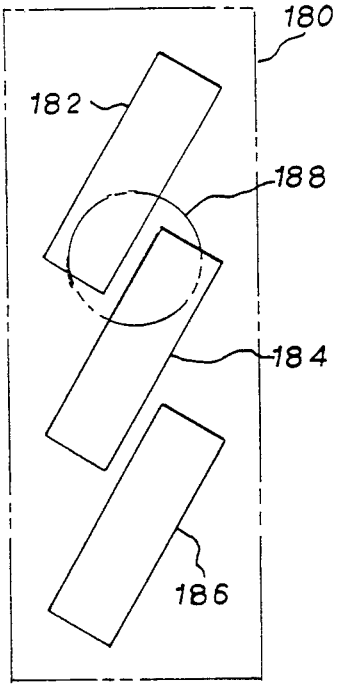
FIG. 16

VERTICAL THREE CYLINDER TWO CYCLE ENGINE WITH SINGLE CARBURETOR

BACKGROUND AND SUMMARY

The invention relates to two cycle internal combustion engines with vertically in-line cylinders, and more particularly to simple and significantly cost-reduced fuel delivery structure therefor.

The invention arose during development efforts directed toward two cycle internal combustion marine engines having three cylinders vertically in-line. In the prior art, each cylinder has its own carburetor which supplies fuel through a respective reed block into the crankcase. The carburetor throttles are connected to each other by throttle linkage. This system is costly because of the expense of three separate carburetors. Furthermore, tuning requires not only synchronization of all three carburetors through the linkage, but also three sets of adjustments, e.g. three separate idle mixture adjustment screws, three choke linkages, etc.

The present invention provides a simple and effective solution to the above noted problems, and provides a significant cost reduction. A single intake manifold services all three cylinders, and a single fuel delivery device on the manifold delivers fuel to all of the cylinders. The invention eliminates the extra carburetors, the complicated linkage system, the extra adjustments, etc.

BRIEF DESCRIPTION OF THE DRAWINGS

Prior Art

Present Invention

Figure 1:
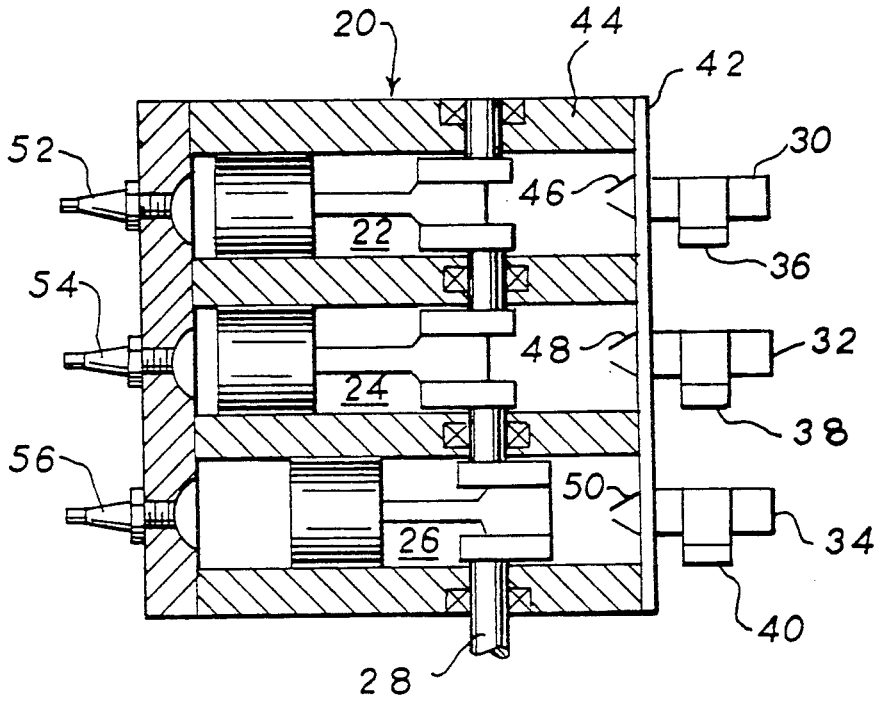
FIG. 1 PRIOR ART
FIG. 1 is a schematic illustration of a two cycle internal combustion engine with three cylinders vertically in-line, as known in the prior art.
Figure 4:
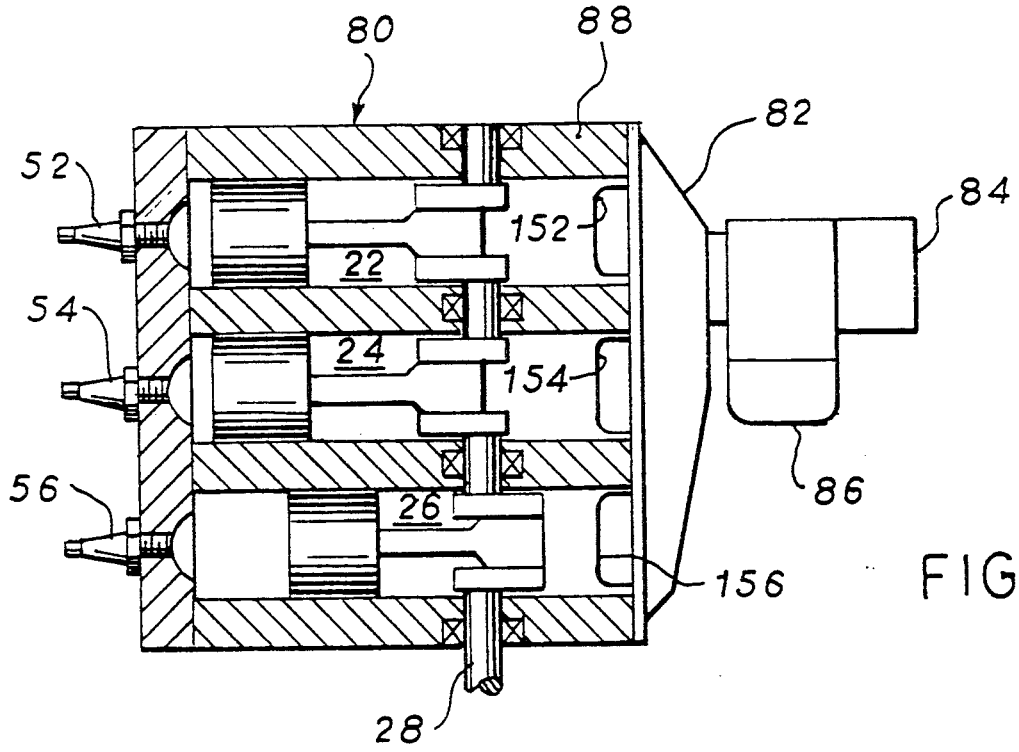

FIG. 4 is a view like FIG. 1 and illustrates the present invention.

FIG. 5 is a perspective view with some further detail of a portion of the structure of FIG. 4.

FIG. 6 is a schematic view looking into the crankcase of FIG. 5 and illustrates the present invention.

Figure 3:
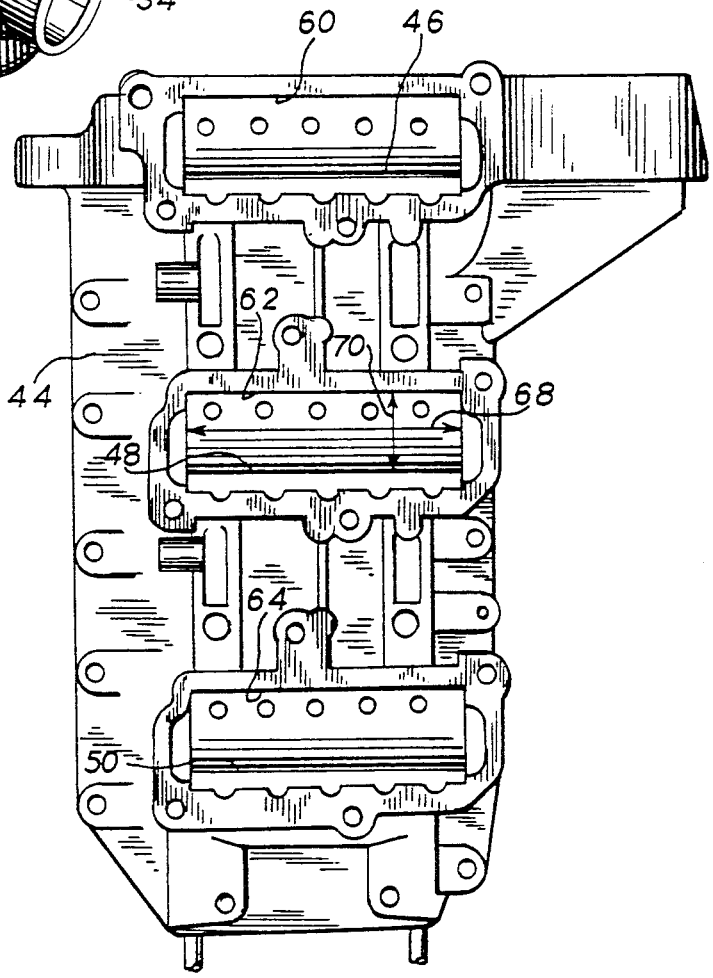
FIG. 3 PRIOR ART
FIG. 3 is a side plan view looking into the crankcase of FIG. 2.

FIG. 7 is like FIG. 3 and shows the present invention.

FIG. 8 is a side plan view of a portion of the structure of FIG. 5.

FIG. 9 is a perspective view of the manifold of FIG. 5.

FIG. 10 is a perspective view of the reverse side of the manifold of FIG. 9.

Figure 11:
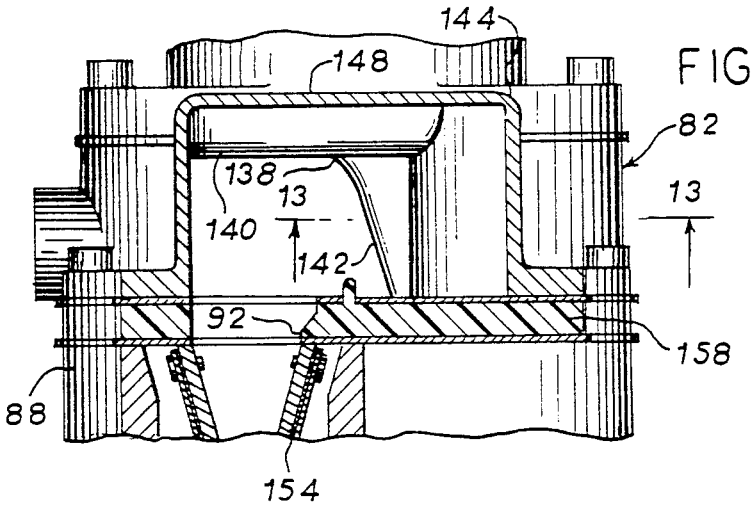

FIG. 11 is a sectional view taken along line 11—11 of FIG. 8.

Figure 12:
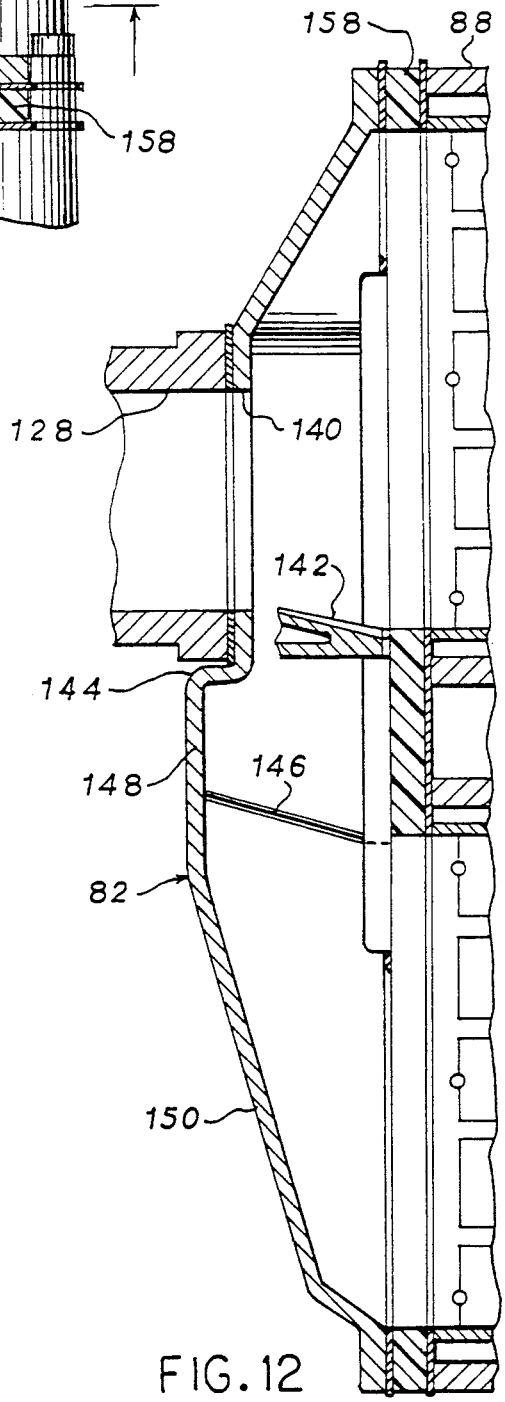

FIG. 12 is a sectional view taken along line 12—12 of FIG. 8.

Figure 13:
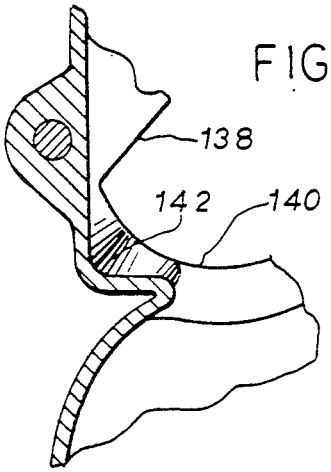

FIG. 13 is a sectional view taken along line 13—13 of FIG. 11.

Figure 14:
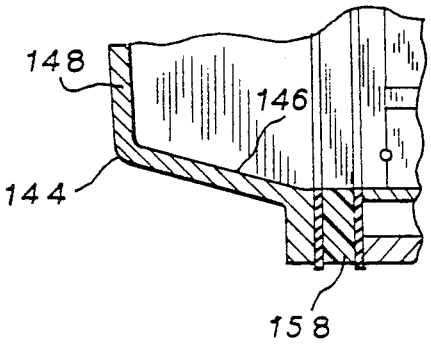

FIG. 14 is a sectional view taken along line 14—14 of FIG. 8.

FIG. 15 is a perspective view of the reed blocks and reed block adaptor of FIG. 5.

FIG. 16 is like FIG. 6 and shows an alternate embodiment.

DETAILED DESCRIPTION

Prior Art

Figure 2:
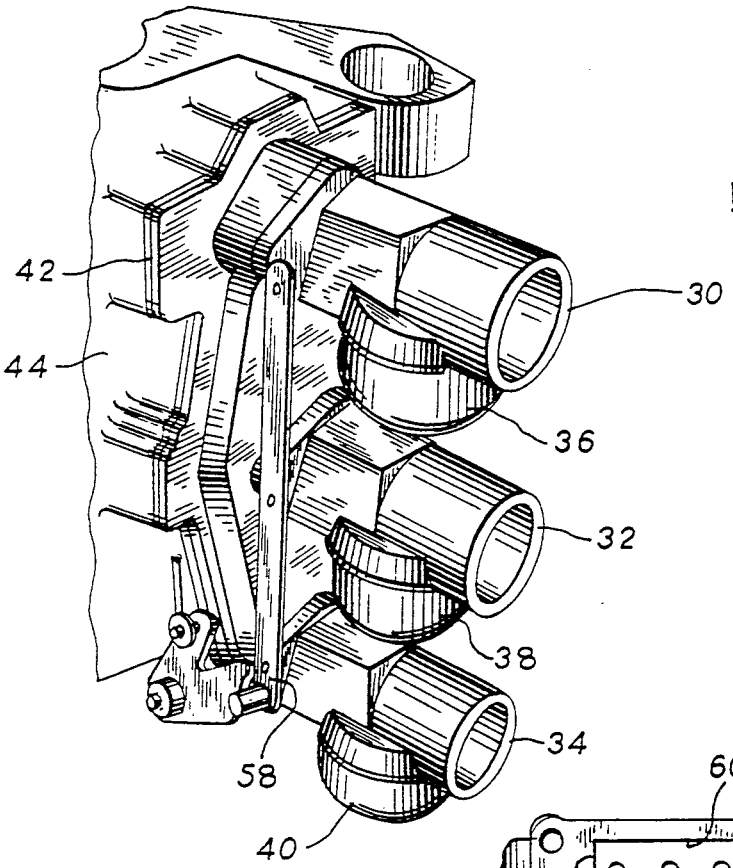
FIG. 2 PRIOR ART
FIG. 2 is a perspective view with some further detail of a portion of the structure of FIG. 1.

FIG. 1 schematically shows a two cycle internal combustion engine 20 having three cylinders 22, 24, 26, vertically in-line and drivingly rotating a vertical crankshaft 28. Each cylinder has its own carburetor 30, 32, 34, respectively, each with a float bowl 36, 38, 40, respectively, as further shown in FIG. 2. The carburetors are mounted to a reed plate adaptor 42 which is mounted to the engine crankcase 44. Three reed blocks 46, 48, 50, one for each cylinder, are mounted to adaptor 42 and extend into the respective cylinder 22, 24, 26, to admit a combustible fuel mixture which flows through respective transfer passages (not shown) to the other end of the respective cylinder for ignition by the respective spark plug 52, 54, 56. The carburetor throttles are connected to each other by throttle linkage 58, FIG. 2. Reed blocks 46, 48, 50 are received in respective reed block openings 60, 62, 64, FIG. 3, in crankcase 44. Each of the reed block openings has a length, as shown at arrow 68, and a width as shown at arrow 70. Length 68 is greater than width 70. Each of the reed block openings extends longitudinally horizontally along the dimension of length 68.

Present Invention

FIG. 4 schematically shows a two cycle internal combustion engine 80 in accordance with the invention and uses like reference numerals from FIG. 1 where appropriate to facilitate understanding. The engine has three cylinders 22, 24, 26 vertically in-line, a single manifold 82 servicing all three of the cylinders, and a single fuel delivery device 84 on the manifold delivering fuel to each of the cylinders. Fuel delivery device 84 is a carburetor having a float bowl 86, FIG. 5, or may alternatively be a throttle body fuel injection device, or the like.

Engine crankcase 88, FIGS. 6 and 7, has first, second and third reed block openings 90, 92, 94, one for each of respective cylinders 22, 24, 26. Manifold 82 covers all of the reed block openings 90, 92, 94, FIG. 8. Reed block opening 90 has a portion 96, FIG. 6, horizontally aligned with a portion 98 of reed block opening 92. Reed block opening 92 has another portion 100 horizontally aligned with a portion 102 of reed block opening 94. Reed block openings 90 and 94 are vertically aligned. Reed block opening 92 is horizontally offset from reed block openings 90 and 94.

Each of the reed block openings has a length, as shown at arrow 104, FIG. 6, and a width, as shown at arrow 106. Length 104 is greater than width 106. Each of the reed block openings extends longitudinally vertically along length 104 between a top end and a bottom end. The bottom end 108 of reed block opening 90 is lower than the top end 110 of reed block opening 92. The bottom end 112 of reed block opening 92 is lower than the top end 114 of reed block opening 94. The longitudinal extent of reed block opening 92 is parallel to the longitudinal extent of reed block opening 90 and parallel to the longitudinal extent of reed block opening 94. The longitudinal extents of reed block openings 90 and 94 are colinear. Reed block opening 90 includes a ramp 116, FIG. 7, within crankcase 88 directing the fuel mixture upwardly towards the center 118 of cylinder 22. Reed block opening 92 includes a ramp 120 within crankcase 88 directing the fuel mixture downwardly towards the center 122 of cylinder 24. Reed block opening 94 includes a ramp 124 within crankcase 88 directing the fuel mixture downwardly towards the center 126 of cylinder 26.

Fuel delivery device 84 has a throttle bore 128, FIG. 5, horizontally aligned with portions 96 and 98, FIG. 6, of reed block openings 90 and 92. Throttle bore 128 has a diameter 130. Reed block openings 90 and 92 are horizontally spaced by a gap 132 having a width less than diameter 130 of throttle bore 128. The top 134 of throttle bore 128 is horizontally aligned with top end 110 of reed block opening 92. The bottom 136 of throttle bore 128 is horizontally aligned with the bottom end 108 of reed block opening 90. Fuel flows along a travel path from throttle bore 128 through manifold 82 generally horizontally to portions 96 and 98 of reed block openings 90 and 92, respectively. The fuel travels generally vertically in manifold 82 to reed block opening 94.

In one embodiment, manifold 82 includes a deflector plate 138, FIGS. 8 and 9, blocking part of the fuel travel path from throttle bore 128 to reed block opening 90. Manifold 82 has an opening 140. Fuel delivery device 84 is mounted to manifold 82 such that throttle bore 128 is aligned with opening 140. Deflector plate 138 extends across a portion of aligned throttle bore 128 and opening 140 and is horizontally aligned with portion 96 of reed block opening 90. Fuel from device 84 strikes deflector plate 138 and disperses rather than directly entering lower portion 96 of reed block opening 90, to prevent an overly rich fuel mixture in upper cylinder 22 during running of the engine at speeds above idle.

Manifold 82 includes a dam 142, FIG. 10, effective at engine idle and diverting to upper cylinder 22 a portion of the gravitationally induced vertical fuel flow which would otherwise drain to lower cylinder 26 during engine idle and cause an overly rich fuel mixture in lower cylinder 26 and an overly lean fuel mixture in upper cylinder 22. Fuel delivery device 84 is mounted to manifold 82 at opening 140 in the manifold horizontally spaced from portions 96 and 98 of reed block openings 90 and 92. Dam 142 is a ramp extending from manifold opening 140 to portion 96 of reed block opening 90 such that fuel from throttle bore 128 of device 84 drains along ramp 142 to portion 96 of reed block opening 90 during engine idle.

Manifold 82 has an outer wall 144, FIGS. 8 and 9, extending downwardly from manifold opening 140. Another dam is provided by a second ramp 146, FIG. 10, extending from outer wall 144 to the bottom end 112 of reed block opening 92, and providing a fuel drain path to reed block opening 92. Outer wall 144 of manifold 82 has a bulged portion 148, FIGS. 9 and 12, bulged outwardly away from and below manifold opening 140 and generally opposite reed block opening 92 to provide increased air volume. Outer wall 144 has a tapered portion 150 tapered downwardly and inwardly from bulged portion 148 and generally opposite reed block opening 94 and providing decreasing air volume. Manifold 82 has a second opening 152, FIG. 9, above opening 140 and generally opposite reed block opening 90. Opening 152 has a fitting 154 for receiving recirculated heavy fuel ends.

Opening 140 in outer wall 144 of manifold 82 is thus opposite and horizontally aligned with portions 96 and 98 of reed block openings 90 and 92. Fuel delivery device 84 is mounted to manifold 82 and has its throttle bore 128 aligned with opening 140 in outer wall 144 of manifold 82. Reed block opening 90 provides fuel to upper cylinder 22. Reed block opening 92 provides fuel to middle cylinder 24. Each of reed block openings 90 and 92 has upper and lower portions. The lower portion 96 of reed block opening 90 is horizontally aligned with upper portion 98 of reed block opening 92. Manifold 82 includes deflector plate 138 blocking a portion of the fuel flow path from throttle bore 128 of device 84 to lower portion 96 of reed block opening 90, such that at engine speeds above idle, fuel from device 84 strikes deflector plate 138 and disperses rather than directly entering lower portion 96 of reed block opening 90, to prevent an overly rich fuel mixture in upper cylinder 22 during running of the engine at speeds above idle. Deflector plate 138 is part of outer wall 144 of manifold 82 and extends across a portion of opening 140 in outer wall 144.

First, second and third reed blocks 152, 154, 156, FIG. 15, are mounted to a reed block adaptor 158, which is mounted between crankcase 88 and manifold 82. Reed blocks 152, 154, 156 are in respective reed block openings 90, 92, 94. Reed block adaptor 158 has an outer peripheral flange 160 sandwiched between crankcase 88 and manifold 82. Reed block adaptor 158 has first, second and third adaptor openings 162, 164, 166, at which reed blocks 152, 154, 156, respectively, are mounted to reed block adaptor 158 by screws such as 168. Each of the adaptor openings has a length, as shown at arrow 170, and a width, as shown at arrow 172. Length 170 is greater than width 172. Each of the adaptor openings extends longitudinally vertically along its length between a top end and a bottom end. Adaptor openings 162 and 166 are vertically aligned. Adaptor opening 164 is horizontally offset from adaptor openings 162 and 166.

Reed block adaptor 158 further includes a raised rib 174 extending longitudinally parallel to the longitudinal extent of adaptor opening 164. Raised rib 174 has a length greater than the length of adaptor opening 164. The longitudinal extents of adaptor openings 162 and 166 extend colinearly, and raised rib 174 extends longitudinally parallel to the longitudinal extents of adaptor openings 162 and 166.

In the preferred embodiment, the bottom 136, FIG. 6, of throttle bore 128 is located slightly above or horizontally level with the bottom end 108 of upper reed block opening 90. The middle reed block opening 92 is located as close as possible across gap 132 to reed block opening 90 in parallel relation. The middle reed block opening 92 is located low enough that the top end 110 of reed block opening 92 is even with the top 134 of throttle bore 128. The lower reed block opening 94 is located as high as possible, i.e. as high as the opening into the crankcase will allow. Minimum manifold cross sectional area deviation from the throttle bore area is desirable. Minimum variation in crankcase volume is also desirable.

FIG. 16 shows an alternate embodiment, with crankcase 180, diagonal reed block openings 182, 184, 186, and throttle bore 188.

It is recognized that various equivalents, alternatives and modifications are possible within the scope of the appended claims.

We claim:

1. A two cycle internal combustion engine comprising three cylinders vertically in-line, a single intake manifold servicing all three of said cylinders, a single fuel delivery device on said manifold delivering fuel to each of said cylinders, said engine comprising a crankcase having first second and third reed block openings, one for each of said cylinders, said manifold covering all of said reed block openings, wherein said first reed block opening has a first portion horizontally aligned with a first portion of said second reed block opening.

2. The invention according to claim 1 wherein said second reed block opening has a second portion horizontally aligned with a first portion of said third reed block opening.

3. The invention according to claim 1 wherein said first and third reed block openings are vertically aligned.

4. The invention according to claim 3 wherein said second reed block opening is horizontally offset from said first and third reed block openings.

5. The invention according to claim 1 wherein each of said reed block openings has a length and a width, said length being greater than said width, each of said reed block openings extending longitudinally along said length between a top end and a bottom end, and wherein the bottom end of said first reed block opening is lower than the top end of said second reed block opening.

6. The invention according to claim 5 wherein the bottom end of said second reed block opening is lower than the top end of said third reed block opening.

7. The invention according to claim 5 wherein the longitudinal extent of said second reed block opening is parallel to the longitudinal extent of said first reed block opening and parallel to the longitudinal extent of said third reed block opening.

8. The invention according to claim 7 wherein the longitudinal extents of said first and third reed block openings are colinear.

9. A two cycle internal combustion engine comprising three cylinders vertically in-line, a crankcase having first, second and third reed block openings, one for each of said cylinders, a single intake manifold covering all of said reed block openings, a single fuel delivery device on said manifold and having a throttle bore horizontally aligned with portions of said first and second reed block openings and delivering fuel to each of said cylinders.

10. The invention according to claim 9 wherein said throttle bore has a given diameter, and wherein said first and second reed block openings are horizontally spaced by a gap having a width less than said diameter of said throttle bore.

11. The invention according to claim 10 wherein each of said reed block openings has a length and a width, said length being greater than said width, each of said reed block openings extending longitudinally along said length between a top end a bottom end, and wherein the bottom end of said first reed block opening is lower than the top end of said second reed block opening, said throttle bore extends horizontally towards said first and second reed block openings, the top of said throttle bore being horizontally aligned with the top end of said second reed block opening, the bottom of said throttle bore being horizontally aligned with the bottom end of said first reed block opening.

12. The invention according to claim 10 wherein fuel flows along a travel path from said throttle bore through said manifold generally horizontally to said portions of said first and second reed block openings.

13. The invention according to claim 12 wherein fuel travels generally vertically in said manifold to said third reed block opening.

14. The invention according to claim 12 wherein said manifold includes a deflector plate blocking part of the fuel travel path from said throttle bore to said first reed block opening.

15. The invention according to claim 14 wherein said manifold has an opening, and wherein said fuel delivery device is mounted to said manifold such that said throttle bore is aligned with said opening, and wherein said deflector plate extends across a portion of said opening horizontally aligned with a portion of said first reed block opening.

16. A two cycle internal combustion engine comprising three cylinders vertically in-line, a crankcase having first, second and third reed block openings, one for each of said cylinders, a single intake manifold covering all of said reed block openings, a single fuel delivery device on said manifold delivering fuel to each of said cylinders, dam means in said manifold diverting to the upper cylinder a portion of the gravitationally induced vertical fuel flow which would otherwise drain to the lower cylinder during engine idle and cause an overly rich fuel mixture in the lower cylinder and an overly lean fuel mixture in the upper cylinder.

17. The invention according to claim 16 wherein said first reed block opening is the uppermost reed block opening and provides fuel for said upper cylinder, said third reed block opening is the lowermost reed block opening and provides fuel for said lower cylinder, said fuel delivery device has a throttle bore horizontally aligned with portions of said first and second reed block openings, said fuel delivery device is mounted to said manifold at an opening in said manifold horizontally spaced from said portions of said first and second reed block openings, said dam means comprises a ramp extending from said manifold opening to said portion of said first reed block opening such that fuel from said fuel delivery device drains along said ramp to said portion of said first reed block opening during engine idle.

18. The invention according to claim 17 wherein each of said reed block openings has a length and a width, said length being greater than said width, each of said reed block openings extending longitudinally along said length between a top end and a bottom end, and wherein the bottom end of said first reed block opening is lower than the top end of said second reed block opening, and said ramp extends from said manifold opening to said bottom end of said first reed block opening and provides a fuel drain path to said first reed block opening.

19. The invention according to claim 18 wherein said manifold has an outer wall extending downwardly from said manifold opening, and wherein said dam means comprises a second ramp extending from said outer wall of said manifold to said bottom end of said second reed block opening and provides a fuel drain path to said second reed block opening.

20. The invention according to claim 19 wherein said outer wall of said manifold has a bulged portion bulged outwardly away from and below said manifold opening and generally opposite said second reed block opening to provide increased air volume.

21. The invention according to claim 20 wherein said outer wall of said manifold has a tapered portion tapered downwardly and inwardly from said bulged portion and generally opposite said third reed block opening and providing decreasing air volume.

22. The invention according to claim 21 wherein said manifold has a second opening above said first mentioned opening in said manifold and generally opposite said first reed block opening, said second opening having a fitting for receiving recirculated heavy fuel ends.

23. The invention according to claim 16 wherein said manifold has an outer wall with an opening opposite and horizontally aligned with portions of said first and second reed block openings, said fuel delivery device is mounted to said manifold and has a throttle bore aligned with said opening in said outer wall of said manifold, wherein said first reed block opening provides fuel to said upper cylinder, and said second reed block opening provides fuel to the middle cylinder of said three cylinders, each of said reed block openings having upper and lower portions, said lower portion of said first reed block opening being horizontally aligned with said upper portion of said second reed block opening, and wherein said manifold includes a deflector plate blocking a portion of the fuel flow path from said fuel delivery device to said lower portion of said first reed block opening, such that at engine speeds above idle, fuel from said fuel delivery device strikes said deflector plate and disperses rather than directly entering said lower portion of said first reed block opening, to prevent an overly rich fuel mixture in said upper cylinder during running of said engine at speeds above idle.

24. The invention according to claim 23 wherein said deflector plate is part of said outer wall of said manifold and extends across a portion of said opening in said outer wall of said manifold.

25. A two cycle internal combustion engine comprising three cylinders vertically in-line, a crankcase having first, second and third reed block openings, one for each of said cylinders, a reed block adaptor, first, second and third reed blocks mounted to said reed block adaptor, a single intake manifold mounted to said crankcase and covering all of said reed block openings, said reed plate adaptor being mounted between said crankcase and said manifold, with said first, second and third reed blocks in said first, second and third reed block openings, respectively, a single fuel delivery device on said manifold delivering fuel to each of said cylinders, said reed block adaptor has an outer peripheral flange sandwiched between said crankcase and said manifold, and has first, second and third adaptor openings at which said first, second and third reed blocks, respectively, are mounted to said reed block adaptor, wherein each of said adaptor openings has a length and a width, said length being greater than said width, each of said adaptor openings extending longitudinally along said length between a top end and a bottom end, wherein said first and third adaptor openings are vertically aligned, and said second adaptor opening is horizontally offset from said first and third adaptor openings, and wherein said reed block adaptor further comprises a raised rib between said second adaptor opening on one side and said first and third adaptor openings on the other side.

26. The invention according to claim 25 wherein said raised rib extends longitudinally parallel to the longitudinal extent of said second adaptor opening.

27. The invention according to claim 26 wherein said raised rib has a length greater than said length of said second adaptor opening.

28. The invention according to claim 26 wherein the longitudinal extents of said first and third adaptor openings extend colinearly, and wherein said raised rib extends longitudinally parallel to the longitudinal extents of said first and third adaptor openings.

* * * * *